US006217215B1

(12) United States Patent
Tomic

(10) Patent No.: US 6,217,215 B1
(45) Date of Patent: Apr. 17, 2001

(54) CLOSURE MECHANISM HAVING A PERCEPTIBLE FEEDBACK SYSTEM

(75) Inventor: Mladomir Tomic, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/348,911

(22) Filed: Jul. 7, 1999

(51) Int. Cl.[7] ..... B65D 33/16
(52) U.S. Cl. ..... 383/63; 24/587
(58) Field of Search ..... 383/63, 65; 24/587, 24/400, 399

(56) References Cited

U.S. PATENT DOCUMENTS

| | | | | |
|---|---|---|---|---|
| 2,794,228 | | 6/1957 | Teher . | |
| 3,372,442 | * | 3/1968 | Ishimatsu | 24/587 |
| 3,579,747 | | 5/1971 | Hawley . | |
| 4,262,395 | | 4/1981 | Kosky . | |
| 4,778,282 | | 10/1988 | Borchardt et al. . | |
| 4,787,755 | * | 11/1988 | Branson | 383/65 |
| 4,791,710 | | 12/1988 | Nocek et al. . | |
| 4,819,309 | * | 4/1989 | Behymer | 24/587 X |
| 4,854,017 | * | 8/1989 | Kamp | 24/587 |
| 4,907,321 | | 3/1990 | Williams . | |
| 4,922,586 | | 5/1990 | Robson . | |
| 5,007,142 | | 4/1991 | Herrington . | |
| 5,056,933 | * | 10/1991 | Kamp | 24/587 X |
| 5,070,584 | | 12/1991 | Dais et al. . | |
| 5,113,555 | * | 5/1992 | Wilson et al. | 383/63 X |
| 5,138,750 | * | 8/1992 | Gundlach et al. | 383/63 X |
| 5,140,727 | * | 8/1992 | Dais et al. | 383/65 X |
| 5,179,767 | * | 1/1993 | Allan | 383/63 X |
| 5,307,552 | | 5/1994 | Dais et al. . | |
| 5,403,094 | * | 4/1995 | Tomic | 383/65 X |
| 5,647,100 | * | 7/1997 | Porchia et al. | 383/63 X |
| 5,689,866 | * | 11/1997 | Kasai et al. | 383/63 X |
| 5,722,128 | | 3/1998 | Toney et al. . | |
| 5,729,876 | | 3/1998 | Johnson . | |
| 5,774,955 | | 7/1998 | Borchardt et al. . | |
| 5,794,315 | * | 8/1998 | Crabtree et al. | 383/63 X |
| 5,809,621 | | 9/1998 | McCree et al. . | |

* cited by examiner

*Primary Examiner*—Allan N. Shoap
*Assistant Examiner*—Robin A. Hylton

(57) ABSTRACT

A closure arrangement for a flexible package includes first and second opposing profiles having a continuous cross-section. The first profile includes a first plurality of feedback devices. The second profile includes a second plurality of feedback devices. The first and second plurality of feedback devices interact to allow a user of the package to sense when the first and second profiles are interlocking. The first plurality of feedback devices of the first profile may include feedback ridges, feedback depressions, or catches. Methods of sealing a package having feedback devices are also provided.

18 Claims, 8 Drawing Sheets

CLOSURE MECHANISM HAVING A PERCEPTIBLE FEEDBACK SYSTEM

FIELD OF THE INVENTION

The present invention generally relates to closure arrangements for polymer packages, such as plastic bags. In particular, the present invention relates to closure mechanisms having tactile feedback.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some resealable packages enable a user to know when the closure profiles have interlocked. Typically, in order to accomplish this, at least one of the closure profiles is discontinuous in its cross-section in the longitudinal direction. Providing a discontinuous closure profile involves additional manufacturing steps, resulting in increased costs, slower manufacturing rates, and increased scrap rates.

Improvements in the design and manufacture of resealable packages are desirable.

SUMMARY OF THE DISCLOSURE

In one aspect of the present invention, one example embodiment involves a closure arrangement for a flexible package. The closure arrangement includes first and second opposing profiles having a continuous cross-section. The first profile includes a first plurality of feedback devices. The second profile includes a second plurality of feedback devices. The first and second plurality of feedback devices interact to allow a user of the package to sense when the first and second profiles are interlocking.

In another aspect, the first plurality of feedback devices of the first profile includes feedback ridges.

In another aspect, the first plurality of feedback devices of the first profile includes feedback depressions.

In another aspect, the first plurality of feedback devices of the first profile includes catches.

In another aspect, a flexible package has first and second opposing film walls having first and second side seals and a mouth extending between the first and second side seals. The mouth provides access to an interior of the package. The package also includes first and second opposing profiles along the mouth for sealing the mouth. The first and second profiles have structure analogous to that previously described.

In another aspect, a method of closing a flexible package having a closure arrangement is provided. The closure arrangement includes opposing first and second closure profiles. The method includes applying pressure to the first and second closure profiles to cause the first and second closure profiles to interlock; feeling the first and second closure profiles interlocking; and continuing to apply or reapplying pressure to the first and second profiles until the first and second profiles are interlocked.

The above summary of principles of the disclosure is not intended to describe each illustrated embodiment or every implementation of the present disclosure. The figures and the detailed description that follow more particularly exemplify certain preferred embodiments utilizing the principles disclosed herein.

BRIEF DESCRIPTION OF THE DRAWINGS

Principles of the invention may be more completely understood in consideration of the detailed description of various embodiments of the invention that follows in connection with the accompanying drawings in which.

Figure 1:
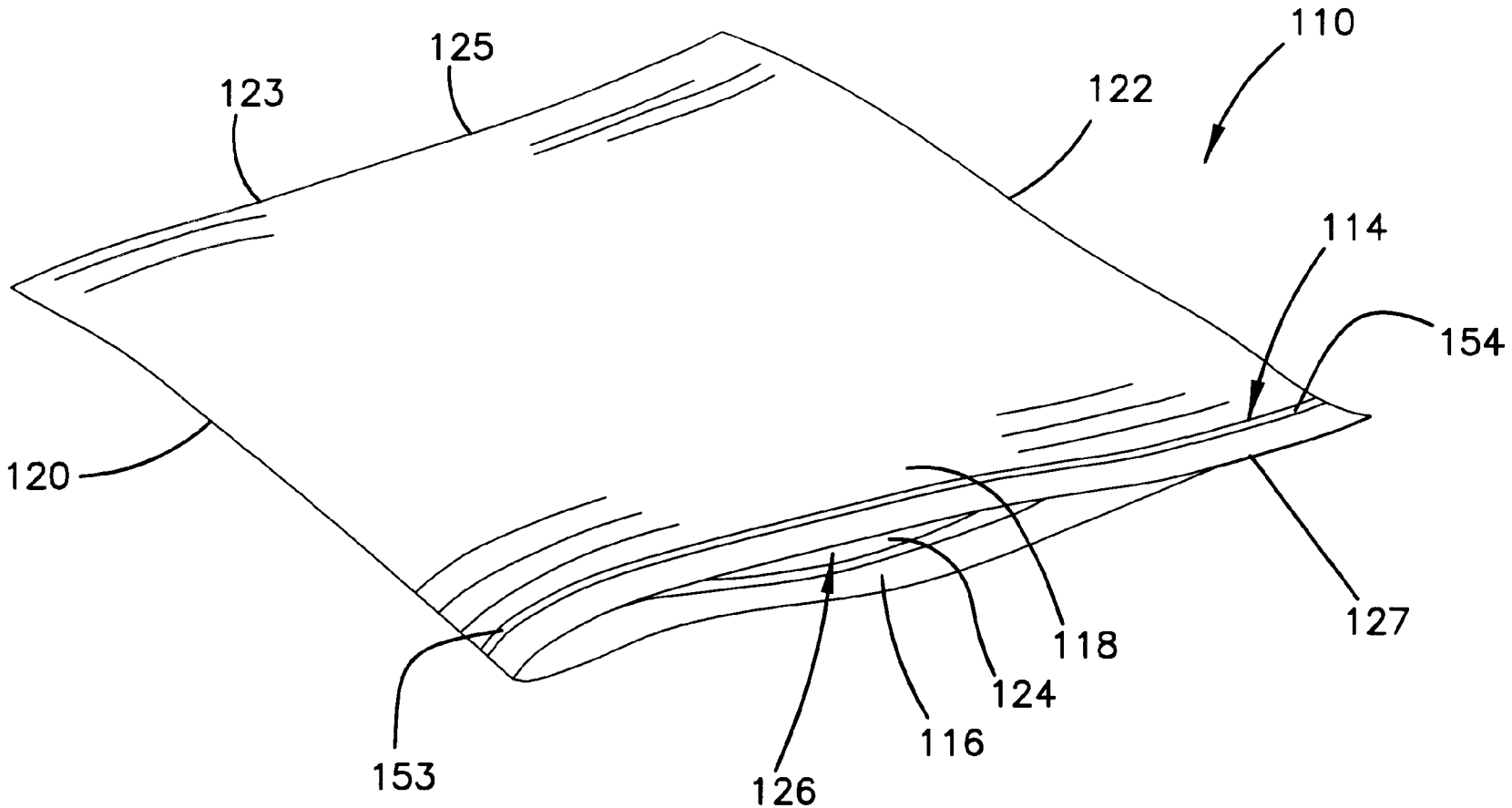
FIG. 1 is a perspective view of a flexible, resealable package having a resealable zipper, according to an example embodiment of the present invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

The principles described herein are believed to be applicable to a variety of packaging arrangements. The principles of the disclosure have been found to be particularly advantageous for manufacturing resealable packages. An appreciation of various aspects is best gained through a discussion of an application example for such a packaging arrangement.

Attention is directed to FIG. 1. FIG. 1 illustrates an example packaging arrangement in the form of a resealable, flexible package 110, for example, a polymeric package such as a plastic bag, having a resealable closure mechanism 114, for example, interlocking profiled elements, constructed in accordance with the present invention. The flexible package 110 includes first and second opposed panel sections 116, 118, typically made from a flexible, polymeric, plastic film, such as a low density polyethylene.

With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. Preferably, the top edge 127 is continuous along its length. By the term "continuous" it is meant that the top edge 127 is uninterrupted by notches or cuts. In the particular embodiment illustrated in FIG. 1, the mouth 126 extends the width of the package 110. The resealable closure mechanism 114 is illustrated at the mouth 126 of the flexible package 110. Preferably, the cross-section of the closure mechanism 114 is continuous along its length across the mouth 126 of the package 110. Alternatively, the closure mechanism 114 could be positioned on the package 110 at a location different from the mouth 126 of the package 110, depending on the application needs for the package 110.

The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
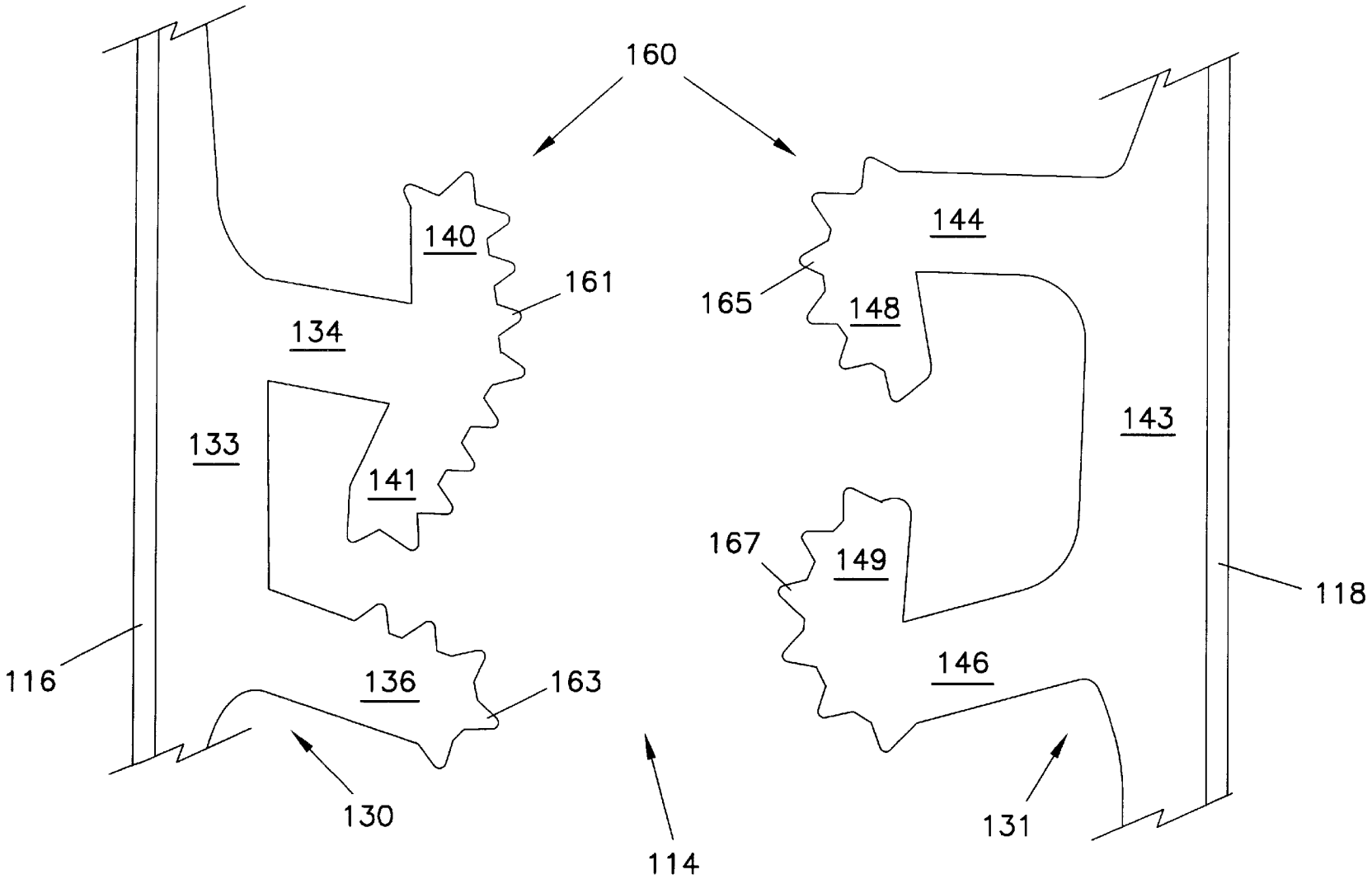
FIG. 2 is an enlarged, fragmented, cross-sectional view of a single-track zipper having a tactile feedback system, according to an example embodiment of the present invention.

In particular, the zipper-type closure mechanism in FIG. 2 is an illustration of one example of a resealable closure mechanism 114. The closure mechanism 114 includes an elongated first closure profile 130 and an elongated second closure profile 131. Preferably, the first and second closure profiles 130, 131 have a continuous cross-section across the length of the closure mechanism 114. By the term "continuous," it is meant that the cross-section is constant and non-varying at any location across the length of the closure mechanism 114. The closure profiles 130, 131 may be extruded or manufactured separately from each other or together.

Still in reference to FIG. 2, the preferred first closure profile 130 depicted includes a base strip 133, a first closure member or profile element 134, and a first guide post 136. The first profile element 134 extends from the base strip 133 and is generally projecting from the base strip 133. At a free end or tip of the profile element 134 are first and second hooks or catches 140, 141. The guide post 136 also extends from the base strip 133 and is generally projecting from the base strip 133. The guide post 136 aids in holding the closure mechanism 114 closed and in aligning the first closure profile 130 with the second closure profile 131 for interlocking.

The preferred second closure profile 131 depicted includes a base strip 143 and first and second closure members or profile elements 144, 146. The profile elements 144, 146 extend from the base strip 143 and are generally projecting from the base strip 143. At a free end or tip of the first profile element 144 is a first hook or catch 148. Likewise, at a free end or tip of the second profile element 146 is a second hook or catch 149.

The first and second closure profiles 130, 131 are designed and constructed to engage with one another to form the resealable closure mechanism 114. The first profile element 134 of the first closure profile 130 extends from the base strip 133 an engagement distance. The first and second profile elements 144, 146 of the second closure profile 131 also extend from the base strip 143 an engagement distance. These engagement distances that the profile elements 134, 144, 146 extend are sufficient to allow mechanical engagement, or interlocking, between the profile element 134 of the first closure profile 130 and the first and second profile elements 144, 146 of the second closure profile 131.

In particular, the first catch 140 of the profile element 134 of the first closure profile 130 hooks or engages with the first catch 148 of the first profile element 144 of the second closure profile 131. Likewise, the second catch 141 of the first profile element 134 of the first closure profile 130 hooks or engages with the second catch 149 of the second profile element 146 of the second closure profile 131. Furthermore, the closure profiles 130, 131 are sealed together at their ends, such as first and second regions 153, 154 of FIG. 1 to further aid in aligning the closure profiles 130, 131 for interlocking. Pressure is applied to the closure profiles 130, 131 as they engage to form the openable sealed closure mechanism 114. Pulling the first closure profile 130 and the second closure profile 131 away from each other causes the two closure profiles 130, 131 to disengage, opening the package 110 of FIG. 1. This provides access to the contents of the package 110 through the mouth 126.

In some applications, the closure profiles 130, 131 are formed by two separate extrusions or through two separate openings of a common extrusion. Typically, the resealable closure mechanism 114 is made of a polymer, plastic material, such as polyethylene or polypropylene. In one example embodiment, the closure arrangement illustrated in FIG. 2 is manufactured using conventional extrusion and heat sealing techniques.

The first closure profile 130 is typically secured to a first panel section, such as the first panel section 116 of the package 110 of FIG. 1, by conventional heat-sealing techniques. The second closure profile 131 is typically secured to a second panel section, such as the second panel section 118 of the package 110 of FIG. 1.

Still in reference to FIG. 2, the resealable closure mechanism 114 further includes a tactile feedback system 160 that enables a user to sense when the resealable closure mechanism 114 has been sealed. The tactile feedback system 160 allows the user to feel when the closure profiles 130, 131 are interlocking. By the term "feel," it is meant that when the user applies pressure to the closure profiles 130,131, usually by sliding her or his fingers across a backside of the closure profiles 130, 131, the user senses a rough or bumpy feeling. As the closure mechanism 114 is sealed, the bumps are smoothed out, such that upon applying pressure a second time, the user feels less bumps. When the user does not feel any bumps, the closure mechanism 114 is sealed. The tactile feedback system 160 may also allow the user to hear when the closure profiles 130, 131 are interlocking. By the term "hear," it is meant that the bumps, that the user feels, create noise that is perceptible to the user with average hearing. Preferably, the noise is a snapping or crackling sound. As the bumps are smoothed out, the noise disappears, providing an indication to the user that the profiles 130, 131 are interlocked.

In particular, in the preferred embodiment, the profile element 134 of the first closure profile 130 has a plurality of integral feedback devices. In FIG. 2, the feedback devices are represented generally as feedback ridges or ribs 161. The feedback ribs 161 shown are generally triangular in shape and project from the profile element 134. Preferably, the feedback ribs 161 project from the profile element 134 at least 0.003 inches (0.076 mm). Of course, the feedback ribs 161 can be other desired sizes or shapes.

Preferably, the guide post 136 of the first closure profile 130 also has a plurality of integral feedback ridges or ribs 163. In the embodiment shown, the ribs 163 are generally triangular in shape and project from the guide post 136. The first and second profile elements 144, 146 of the second closure profile 131 also have a plurality of integral feedback ridges or ribs 165, 167, respectively. In the preferred embodiment, the feedback ribs 161, 163 of the first closure profile 130 are designed and constructed to rub against and interact with the feedback ribs 165, 167 of the second closure profile 131. By the term "interact," it is meant that the feedback ribs 161 of the closure member 134 of the first closure profile 130 move between and over the feedback ribs 165, 167 of the first and second closure members 144, 146 of the second closure profile 131 during engagement. Likewise, the feedback ridges or ribs 163 of the guide post 136 of the first closure profile 130 rub against and interact with the feedback ribs 167 of the second profile element 146 of the second closure profile 131 during engagement. The feedback ribs 161, 163, 165, 167 are designed to somewhat impede the interlocking of the closure profiles 130, 131, providing tactile feedback to the user of the mechanism 114.

The feedback ribs 161, 163, 165, 167 are generally extruded with the closure profiles 130, 131. The feedback ribs 161, 163, 165, 167 can be extruded from a dissimilar material than the closure profiles 130, 131, such as a polypropylene copolymer or a medium density polyethylene.

Preferably during engagement, the catches 140, 141 of the closure member 134 of the first closure profile 130 slide past the catches 148, 149 of the first and second closure members 144, 146 of the second closure profile 131 to interlock. As the catches 140, 141 of the first closure profile 130 slide past the catches 148, 149 of the second closure profile 131, the feedback ribs 161, 163 of the first closure profile 130 rub against and interact with the feedback ribs 165, 167 of the second closure profile 131. As the feedback ribs 161, 163, 165, 167 interact and move between and over each other, they exert a force on the first and second closure profiles 130, 131, causing the first and second closure profiles 130, 131 to move or vibrate. This movement provides an indication to the user that the first and second closure profiles 130, 131 are interlocking. In addition, as the feedback ribs 161, 163, 165, 167 interact with each other, they create an audible sound that indicates to the user that the first and second closure profiles 130, 131 are interlocking.

In an alternative embodiment, the closure profiles 130, 131 could have any number of feedback ridges or ribs. In another alternative embodiment, only the profile element 134 of the first closure profile 130 and the first profile element 144 of the second closure profile 131 have feedback ribs. In yet another alternative embodiment, any number of feedback ribs may exist on any number of projecting members of the first and second closure profiles 130, 131.

Figure 3:
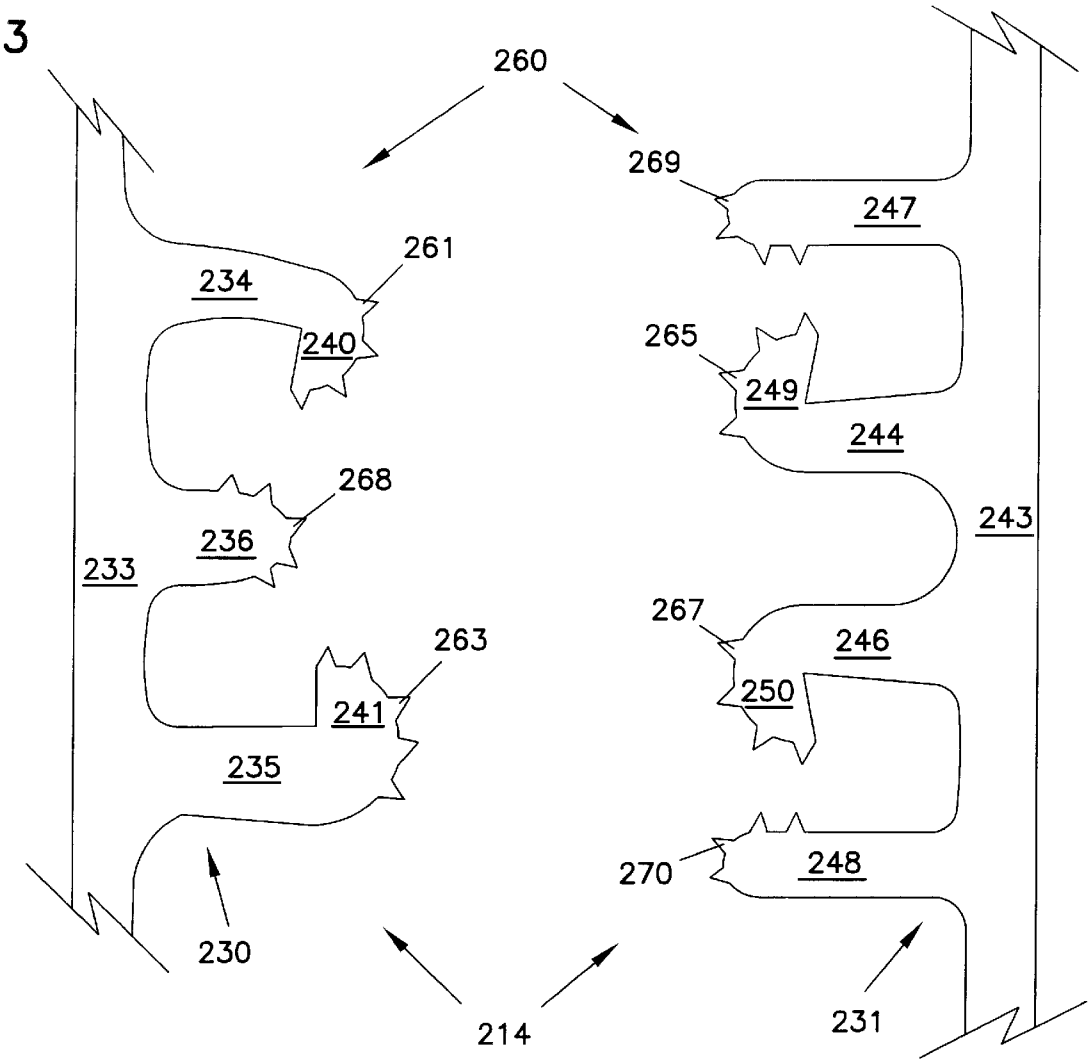
FIG. 3 is an enlarged, fragmented, cross-sectional view of another alternate embodiment of a tactile feedback system, being a dual-track zipper having tactile feedback ribs, according to an example embodiment of the present invention.

Attention is directed to FIG. 3. FIG. 3. illustrates a multi-track zipper 214, or closure mechanism, having a tactile feedback system 260 according to another example embodiment of the present invention. By the term "multi-track," it is meant two or more pairs of interchanging hooks or catches. The multi-track zipper 214 has a first closure profile 230 and a second closure profile 231. Preferably, the first and second closure profiles 230, 231 have a continuous cross-section across the length of the closure mechanism 214.

The preferred first closure profile 230 depicted includes a base strip 233, a first closure member or profile element 234, a second closure member or profile element 235, and a first guide post 236. The first profile element 234 extends from the base strip 233 and is generally projecting from the base strip 233. At a free end or tip of the profile element 234 is a first hook or catch 240. Likewise, the second profile element 235 extends from the base strip 233 and is generally projecting from the base strip 233. At a free end or tip of the profile element 235 is a second hook or catch 241. The guide post 236 also extends from the base strip 233 and is generally projecting from the base strip 233. The guide post 236 aids in holding the closure mechanism 214 closed and in aligning the first closure profile 230 with the second closure profile 231 for interlocking.

The preferred second closure profile 231 depicted includes a base strip 243, first and second profile elements or profile elements 244, 246, and first and second guide posts 247, 248. The profile elements 244, 246 extend from the base strip 243 and are generally projecting from the base strip 243. At a free end or tip of the first profile element 244 is a first hook or catch 249. Likewise, at a free end or tip of the second profile element 246 is a second hook or catch 250. The guide posts 247, 248 also extend from the base strip 243 and are generally projecting from the base strip 243. The guide posts 247, 248 aid in holding the closure mechanism 214 closed and in aligning the second closure profile 231 with the first closure profile 230 for interlocking.

The first and second closure profiles 230, 231 are designed to engage with one another to form the resealable closure mechanism 214. The first and second profile elements 234, 235 of the first closure profile 230 extend from the base strip 233 an engagement distance. The first and second profile elements 244, 246 of the second closure profile 231 also extend from the base strip 243 an engagement distance. These engagement distances that the profile elements 234, 235, 244, 246 extend are sufficient to allow mechanical engagement, or interlocking, between the first and second profile elements 234, 235 of the first closure profile 230 and the first and second profile elements 244, 246 of the second closure profile 231.

In particular, the first catch 240 of the first profile element 234 of the first closure profile 230 hooks or engages with the first catch 249 of the first profile element 244 of the second closure profile 231. Likewise, the second catch 241 of the second profile element 235 of the first closure profile 230 hooks or engages with the second catch 250 of the second profile element 246 of the second closure profile 231. Furthermore, the closure profiles 230, 231 are sealed together at their ends, such as the first and second regions 153, 154 of FIG. 1, through processes such as ultrasonic crushing, to further aid in aligning the closure profiles 230, 231 for interlocking. Pressure is applied to the closure profiles 230, 231 as they engage to form the openable sealed closure mechanism 214. Pulling the first closure profile 230 and the second closure profile 231 away from each other causes the two closure profiles 230, 231 to disengage, opening the package 110 of FIG. 1.

Still in reference to FIG. 3, the resealable closure mechanism 214 includes a tactile feedback system 260 that enables a user to sense when the resealable closure mechanism 214 has been sealed. In particular, the first and second profile elements 234, 235 of the first closure profile 230 have a plurality of feedback devices. In FIG. 3, the feedback devices are represented generally as integral feedback ridges or ribs 261, 263, respectively. Likewise, the first and second profile elements 244, 246 of the second closure profile 231 have a plurality of integral feedback ridges or ribs 265, 267, respectively. The guide posts 236, 247, 248 also have feedback ridges or ribs 268, 269, 270, respectively. The feedback ribs 261, 263, 265, 267, 268, 269, 270 have structure analogous to the feedback ribs 161, 163, 165, 167 of FIG. 2.

The feedback ribs 261 of the first profile element 234 of the first closure profile 230 are designed and constructed to rub against or interact with the feedback ribs 265, 269 of the first profile element 244 and the first guide post 247, respectively, of the second closure profile 231. Likewise, the feedback ribs 263 of the second profile element 235 of the first closure profile 230 are designed and constructed to rub against or interact with the feedback ribs 267, 270 of the second profile element 246 and the second guide post 248, respectively, of the second closure profile 231. The feedback ribs 268 of the guide post 236 of the first closure profile 230 are designed and constructed to rub against and interact with the feedback ribs 265, 267 of the first and second profile elements 244, 246, respectively, of the second closure profile 231.

During engagement, the catches 240, 241 of the first closure profile 230 slide past the catches 249, 250 of the second closure profile 231 to interlock. As the catches 240, 241 of the first closure profile 230 slide past the catches 249, 250 of the second closure profile 231, the feedback ribs 261, 263, 268 of the first closure profile 230 rub against and interact with the feedback ribs 265, 267, 269, 270 of the second closure profile 231. As the feedback ribs 261, 263, 265, 267, 268, 269, 270 interact and move between and over each other, they exert a force on the first and second closure profiles 230, 231, causing the first and second closure profiles 230, 231 to move or vibrate. This movement provides an indication to the user that the first and second closure profiles 230, 231 are interlocking. In addition, as the feedback ribs 261, 263, 265, 267, 268, 269, 270 interact with each other, they create an audible sound that indicates to the user that the first and second closure profiles 230,231 are interlocking.

Figure 4:
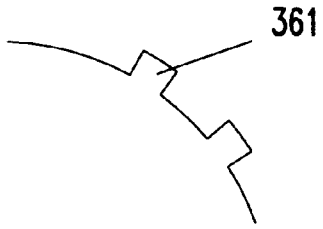
FIG. 4 is an enlarged fragmented, cross-sectional view of an alternate embodiment of tactile feedback ribs, according to an example embodiment of the present invention.

Attention is directed to FIG. 4. FIG. 4 illustrates an alternative embodiment of feedback ridges or ribs 361. In this embodiment, the feedback ribs 361 have a rectangular shape. With this exception, the feedback ribs 361 have structure analogous to the feedback ribs 161 of FIG. 2.

Figure 5:
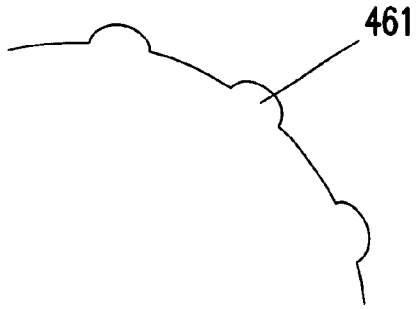
FIG. 5 is an enlarged, fragmented, cross-sectional view of another alternate embodiment of tactile feedback ribs, according to an example embodiment of the present invention.

Attention is directed to FIG. 5. FIG. 5 illustrates another alternative embodiment of feedback ridges or ribs 461. In this embodiment, the feedback ribs 461 have a round shape. With this exception, the feedback ribs 461 have structure analogous to the feedback ribs 161 of FIG. 2.

Figure 6:
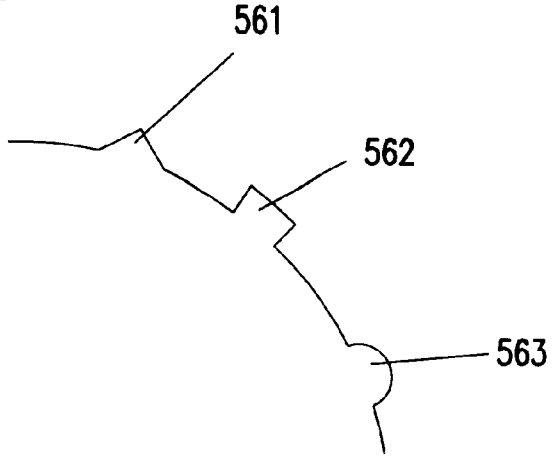
FIG. 6 is an enlarged, fragmented, cross-sectional view of another alternate embodiment of tactile feedback ribs, according to an example embodiment of the present invention.

Attention is directed to FIG. 6. FIG. 6 illustrates yet another alternative embodiment of feedback ridges or ribs 561, 562, 563. In this embodiment, the first feedback rib 561 has a triangular shape, the second feedback rib 562 has a rectangular shape, and the third feedback rib 563 has a round shape. Alternatively, any size or shape could be utilized as well as any combination of sizes or shapes for a plurality of feedback ribs.

Figure 7:
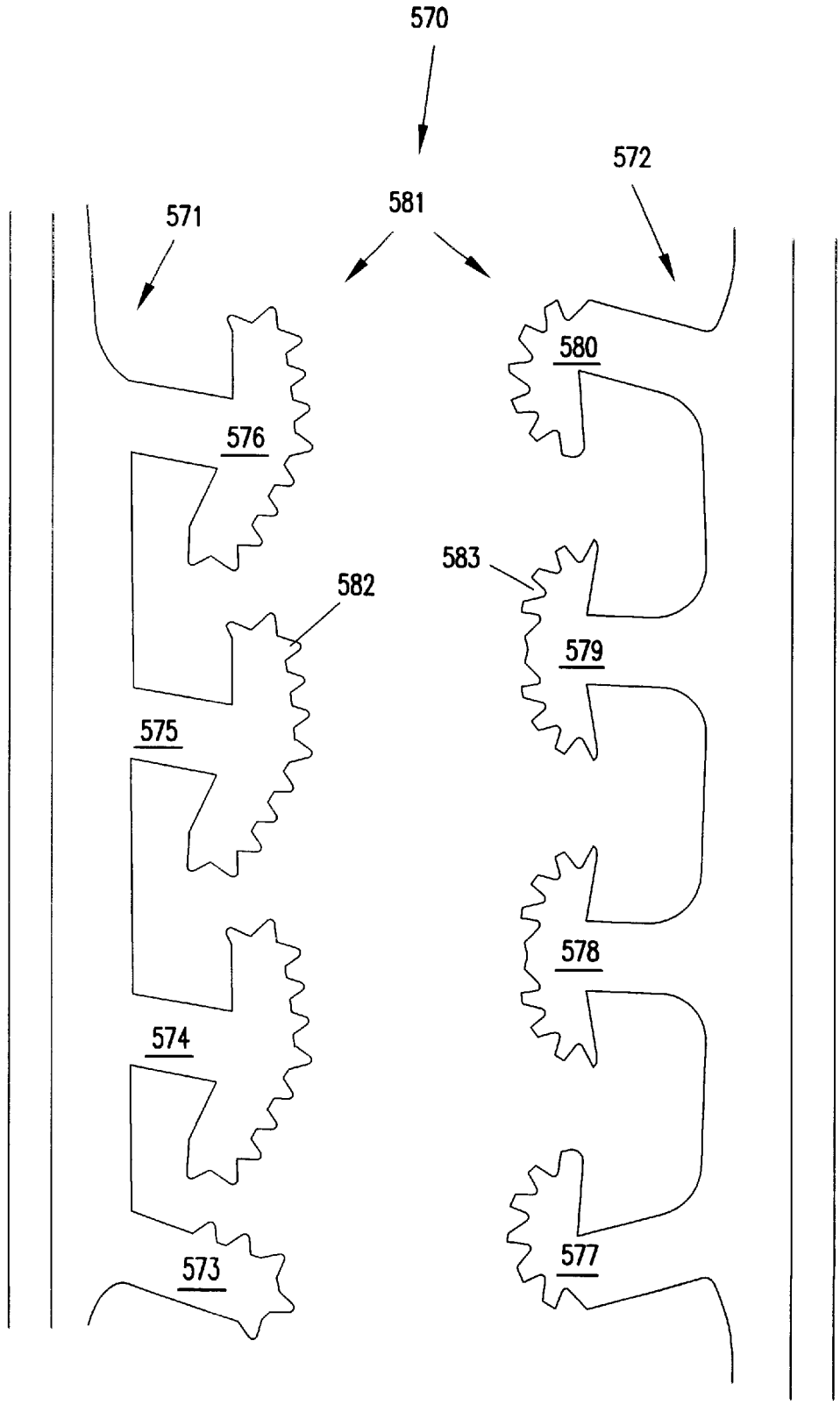
FIG. 7 is an enlarged, fragmented, cross-sectional view of another alternate embodiment of a tactile feedback system, being a multi-track zipper having tactile feedback snaps and depressions, according to an example embodiment of the present invention.

Attention is directed to FIG. 7. FIG. 7 illustrates an alternative embodiment. A resealable closure mechanism 570 includes first and second closure profiles 571, 572. The first and second closure profiles 571, 572 have a continuous cross-section across the length of the closure mechanism 570. The first closure profile 571 includes a guide post 573, a first profile element 574, a second profile element 575, and a third profile element 576. The second closure profile 572 includes a first profile element 577, a second profile element 578, a third profile element 579, and a fourth profile element 580. The first and second closure profile 571, 572 are designed and constructed to engage with each other. Alternatively, the first and second closure profiles 571, 572 may include any number of profiled elements.

The resealable closure mechanism 570 includes a tactile feedback system 581. The first closure profile 571 includes a plurality of feedback devices. In FIG. 7, the feedback devices of the first closure profile 571 are represented generally as feedback ridges or ribs 582. The feedback ridges or ribs 582 have structure analogous to the feedback ribs 161 of FIG. 2. The second closure profile 572 also includes a plurality of feedback devices. The feedback devices of the second closure profile 572 are represented generally as feedback depressions 583. Generally the feedback depressions 583 are triangular in shape. Preferably, the feedback depressions 583 extend into the profile elements 577, 578, 579, 580 at least 0.003 inches (0.076 mm). Of course, the feedback depressions 583 can be other sizes or shapes desired. The feedback ribs 582 rub against and interact with the feedback depressions 583 to provide a tactile feedback to a user when the closure profiles 571, 572 are interlocked. Alternatively, any combination of feedback ribs or depressions, having any size or shape, may be used on the first and second closure profiles 571, 572.

With the exception of the feedback depressions 583 and the multiple profile elements 574, 575, 576, 577, 578, 579, 580, the first and second closure profiles 571, 572 have structure analogous to the first and second closure profiles 130, 131, respectively, of FIG. 2.

Figure 8:
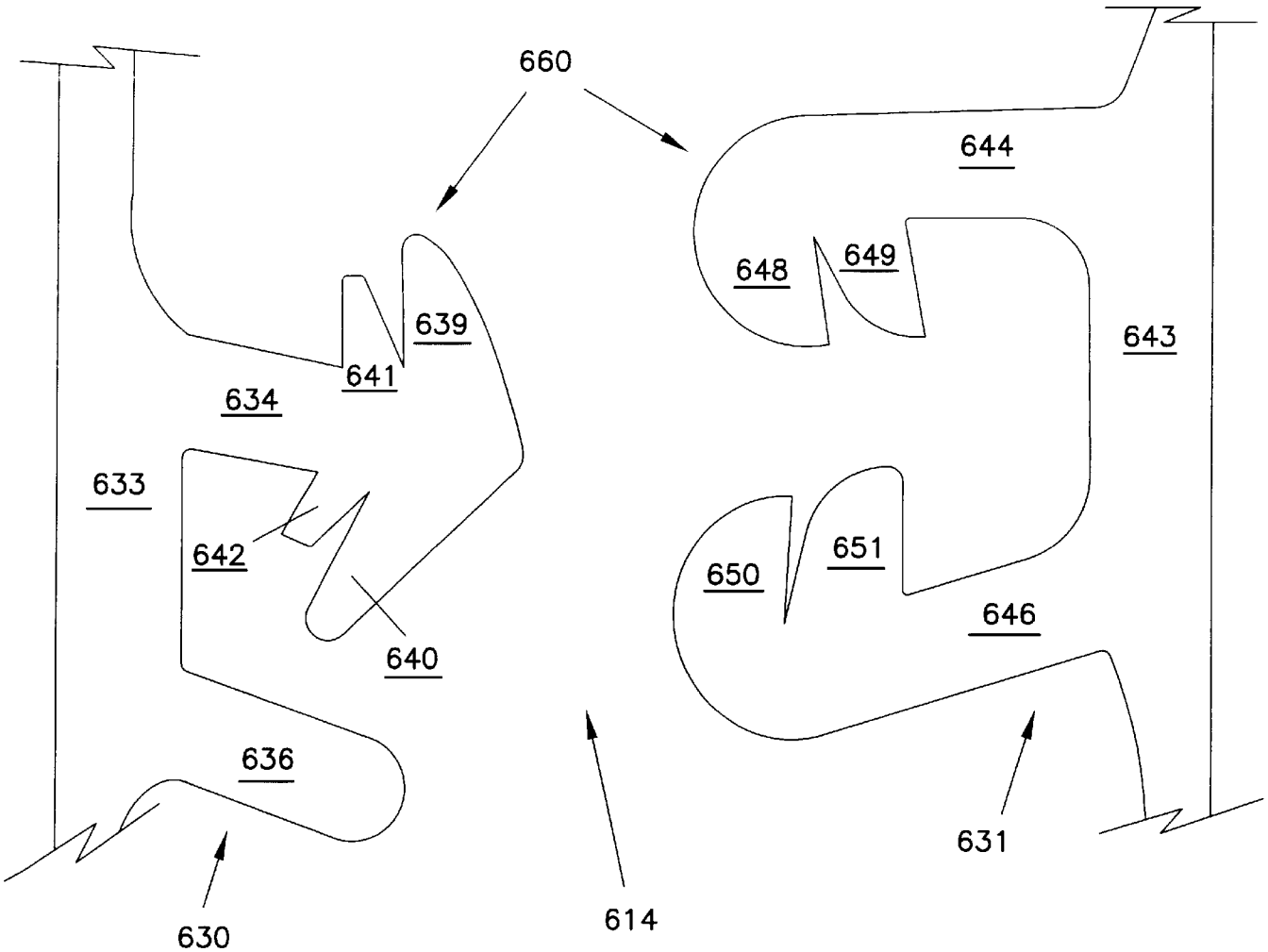
FIG. 8 is an enlarged, fragmented, cross-sectional view of another alternate embodiment of a tactile feedback system, being a single-track zipper having tactile feedback snaps, according to an example embodiment of the present invention.

Attention is directed to FIG. 8. FIG. 8 illustrates a resealable closure mechanism 614 according to another example embodiment of the present invention. The closure mechanism 614 includes a first closure profile 630 and a second closure profile 631. The first and second closure profiles 630, 631 have a continuous cross-section across the length of the closure mechanism 614.

The preferred first closure profile 630 depicted includes a base strip 633, a first closure member or profile element 634, and a first guide post 636. The first profile element 634 extends from the base strip 633 and is generally projecting from the base strip 633. At a free end or tip of the profile element 634 are first and second hooks or catches 639, 640. Between the first and second catches 639,640 and the base strip 633 are third and fourth catches 641, 642. The guide post 636 also extends from the base strip 633 and is generally projecting from the base strip 633. The guide post 636 aids in holding the closure mechanism 614 closed and in aligning the first closure profile 630 with the second closure profile 631 for interlocking.

The preferred second closure profile 631 depicted includes a base strip 643 and first and second closure members or profile elements 644, 646. The profile elements 644, 646 extend from the base strip 643 and are generally projecting from the base strip 643. At a free end or tip of the first profile element 644 is a first hook or catch 648. Between the first catch 648 and the base strip 643 is a second hook or catch 649. Likewise, at a free end or tip of the second profile element 646 is a third hook or catch 650. Between the third catch 650 and the base strip 643 is a fourth hook or catch 651.

The first and second closure profiles 630, 631 are designed to engage with one another to form the resealable closure mechanism 614. The first profile element 634 of the first closure profile 630 extends from the base strip 633 an engagement distance. The first and second profile elements 644, 646 of the second closure profile 631 also extend from the base strip 643 an engagement distance. These engagement distances that the profile elements 634, 644, 646 extend are sufficient to allow mechanical engagement, or interlocking, between the first profile element 634 of the first closure profile 630 and the first and second profile elements 644, 646 of the second closure profile 631.

In particular, the first and third catches 639, 641 of the first profile element 634 of the first closure profile 630 hook or engage with the first and second catches 648, 649 of the first profile element 644 of the second closure profile 631. Likewise, the second and fourth catches 640, 642 of the first profile element 634 of the first closure profile 630 hook or engage with the first and second catches 650, 651 of the second profile element 646 of the second closure profile 631. Furthermore, the closure profiles 630, 631 are sealed together at their ends, such as first and second regions 153, 154 of FIG. 1 to further aid in aligning the closure profiles 630, 631 for interlocking. Pressure is applied to the closure profiles 630, 631 as they engage to form the openable sealed closure mechanism 614. Pulling the first closure profile 630 and the second closure profile 631 away from each other causes the two closure profiles 630, 631 to disengage, opening the package 110 of FIG. 1.

Still in reference to FIG. 8, the third and fourth catches 641, 642 of the first closure profile 630 and the second catch 649 of the first profile element 644 and the second catch 651 of the second profile element 646 of the second closure profile 631 comprise a tactile feedback system 660 that enables a user to sense when the resealable closure mechanism 614 has been sealed. The tactile feedback system 660 allows the user to feel when the closure profiles 630, 631 are interlocking. In addition, the tactile feedback system 660 may allow the user to hear when the closure profiles 630, 631 are interlocking.

In particular, during engagement, pressure is applied to the first and second closure profiles 630, 631, causing the first catch 639 of the profile element 634 of the first closure profile 630 to engage with the first catch 648 of the first profile element 644 of the second closure profile 631. As the pressure continues, the first catch 639 of the profile element 634 of the first closure profile 630 engages with the second catch 649 of the first profile element 644 of the second closure profile 631, and the third catch 641 of the profile element 634 of the first closure profile 630 engages with the first catch 648 of the first profile element 644 of the second closure profile 631. Likewise, the second catch 640 of the profile element 634 of the first closure profile 630 engages with the first catch 650 of the second profile element 646 of the second closure profile 631. As the pressure continues, the second catch 640 of the profile element 634 of the first closure profile 630 engages with the second catch 651 of the second profile element 646 of the second closure profile 631, and the fourth catch 642 of the profile element 634 of the first closure profile 630 engages with the first catch 650 of the second profile element 646 of the second closure profile 631. As the catches 639, 640, 641, 642, 648, 649, 650, 651 engage each other, they exert a force on the first and second closure profiles 630, 631, causing the first and second closure profiles 630, 631 to move or vibrate. This movement provides an indication to the user that the first and second closure profiles 630, 631 are interlocking. In addition, as the catches 641, 639, 642, 640 of the first closure profile 630 engage with the catches 648, 649, 650, 651, respectively, of the second closure profile 630, they create an audible sound that indicates to the user that the first and second closure profiles 630, 631 are interlocking.

Figure 9:
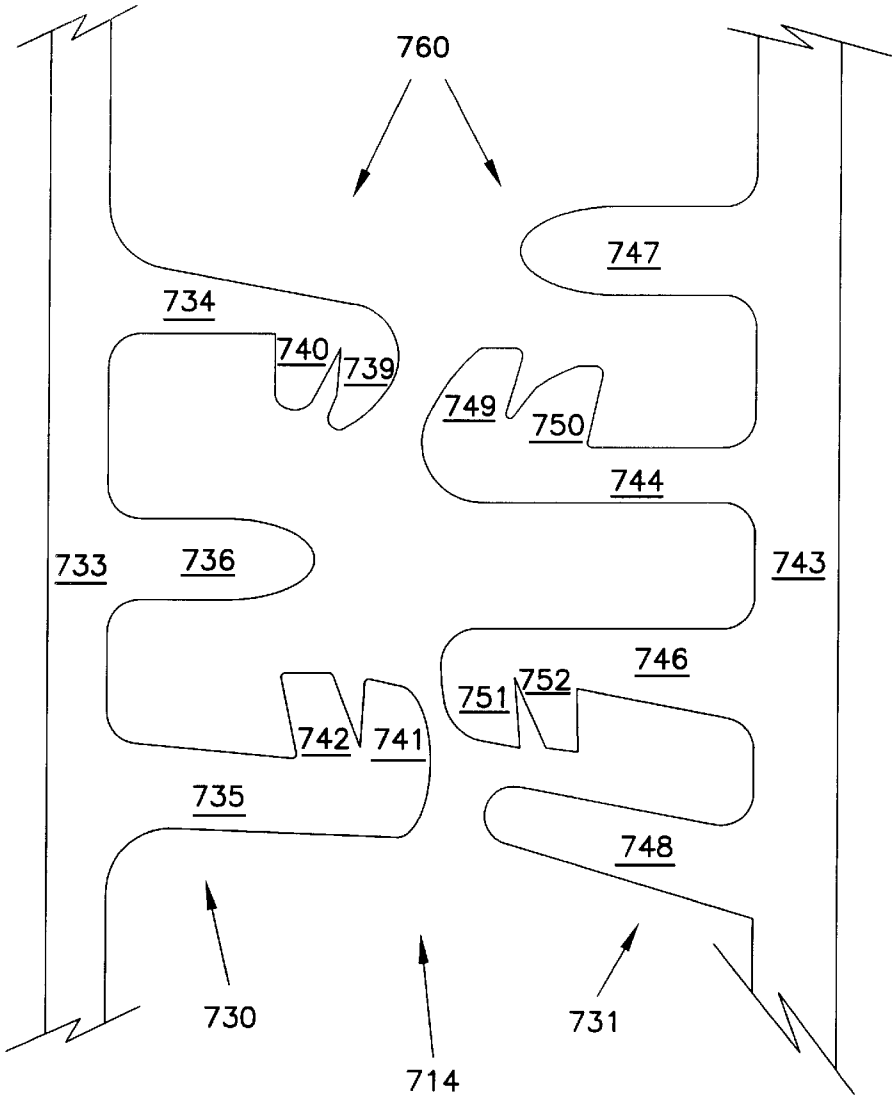
FIG. 9 is an enlarged, fragmented, cross-sectional view of another alternate embodiment of a tactile feedback system, being a dual-track zipper having tactile feedback snaps, according to an example embodiment of the present invention.

Attention is directed FIG. 9. FIG. 9 illustrates a multi-track zipper 714, or closure mechanism, having a tactile feedback system 760 according to an example embodiment of the present invention. The closure mechanism 714 includes a first closure profile 730 and a second closure profile 731. The first and second closure profiles 730, 731 have a continuous cross-section across the length of the closure mechanism 714.

The preferred first closure profile 730 depicted includes a base strip 733, a first closure member or profile element 734, a second closure member or profile element 735, and a first guide post 736. The first profile element 734 extends from the base strip 733 and is generally projecting from the base strip 733. At a free end or tip of the first profile element 734 is a first hook or catch 739. Between the first catch 739 and the base strip 733 is a second catch 740. Likewise, the second profile element 735 extends from the base strip 733 and is generally projecting from the base strip 733. At a free end or tip of the second profile element 735 is a third hook or catch 741. Between the third catch 741 and the base strip 733 is a fourth catch 742. The guide post 736 also extends from the base strip 733 and is generally projecting from the base strip 733. The guide post 736 aids in holding the closure mechanism 714 closed and in aligning the first closure profile 730 with the second closure profile 731 for interlocking.

The preferred second closure profile 731 depicted includes a base strip 743, first and second closure members or profile elements 744, 746, and first and second guide posts 747, 748. The profile elements 744, 746 extend from the base strip 743 and are generally projecting from the base strip 743. At a free end or tip of the first profile element 744 is a first hook or catch 749. Between the first catch 749 and the base strip 743 is a second hook or catch 750. Likewise, at a free end or tip of the second profile element 746 is a third hook or catch 751, and between the third catch 751 and the base strip 743 is a fourth hook or catch 752. The guide posts 747, 748 also extend from the base strip 743 and are generally projecting from the base strip 743. The guide posts 747, 748 aid in holding the closure mechanism 714 closed and in aligning the second closure profile 731 with the first closure profile 730 for interlocking.

The first and second closure profiles 730, 731 are designed to engage with one another to form the resealable closure mechanism 714. The first and second profile elements 734, 735 of the first closure profile 730 extend from the base strip 733 an engagement distance. The first and second profile elements 744, 746 of the second closure profile 731 also extend from the base strip 743 an engagement distance. These engagement distances that the profile elements 734, 735, 744, 746 extend are sufficient to allow mechanical engagement, or interlocking, between the first and second profile elements 734, 735 of the first closure profile 730 and the first and second profile elements 744, 746 of the second closure profile 731.

In particular, the first and second catches 739, 740 of the first profile element 734 of the first closure profile 730 hook or engage with the first and second catches 749, 750 of the first profile element 744 of the second closure profile 731. Likewise, the third and fourth catches 741, 742 of the second profile element 735 of the first closure profile 730 hook or engage with the first and second catches 751, 752 of the second profile element 746 of the second closure profile 731. Furthermore, the closure profiles 730, 731 are sealed together at their ends, such as first and second regions 153, 154 of FIG. 1 to further aid in aligning the closure profiles 730, 731 for interlocking. Pressure is applied to the closure profiles 730, 731 as they engage to form the openable sealed closure mechanism 714. Pulling the first closure profile 730 and the second closure profile 731 away from each other causes the two closure profiles 730, 731 to disengage, opening the package 110 of FIG. 1.

Still in reference to FIG. 9, the catches 739, 740, 741, 742 of the first closure profile 730 and the catches 749, 750, 751, 752 of the second closure profile 731 comprise a tactile feedback system 760 that enables a user to sense when the resealable closure mechanism 714 has been sealed. The tactile feedback system 760 allows the user to feel when the closure profiles 730, 731 are interlocking. In addition, the tactile feedback system 760 may allow the user to hear when the closure profiles 730, 731 are interlocking.

In particular, during engagement, pressure is applied to the first and second closure profiles 730, 731, causing the first catch 739 of the first profile element 734 of the first closure profile 730 to engage with the first catch 749 of the first profile element 744 of the second closure profile 731. As the pressure continues, the first catch 739 of the first profile element 734 of the first closure profile 730 engages with the second catch 750 of the first profile element 744 of the second closure profile 731 and the second catch 740 of the first profile element 734 of the first closure profile 730 engages with the first catch 749 of the first profile element 744 of the second closure profile 731. Likewise, the third catch 741 of the second profile element 735 of the first closure profile 730 engages with the third catch 751 of the second profile element 746 of the second closure profile 731. As the pressure continues, the third catch 741 of the second profile element 735 of the first closure profile 730 engages with the fourth catch 752 of the second profile element 746 of the second closure profile 731, and the fourth catch 742 of the second profile element 735 of the first closure profile 730 engages with the third catch 751 of the second profile element 746 of the second closure profile 731. As the catches 739, 740, 741, 742, 749, 750, 751, 752 engage each other, they exert a force on the first and second closure profiles 730, 731, causing the first and second closure profiles 730, 731 to move or vibrate. This movement provides an indication to the user that the first and second closure profiles 730, 731 are interlocking. In addition, as the catches 739, 740, 741, 742 of the first closure profile 730 engage with the catches 749, 750, 751, 752, respectively, of the second closure profile 731, they create an audible sound that indicates to the user that the first and second closure profiles 730, 731 are interlocking.

Figure 10:
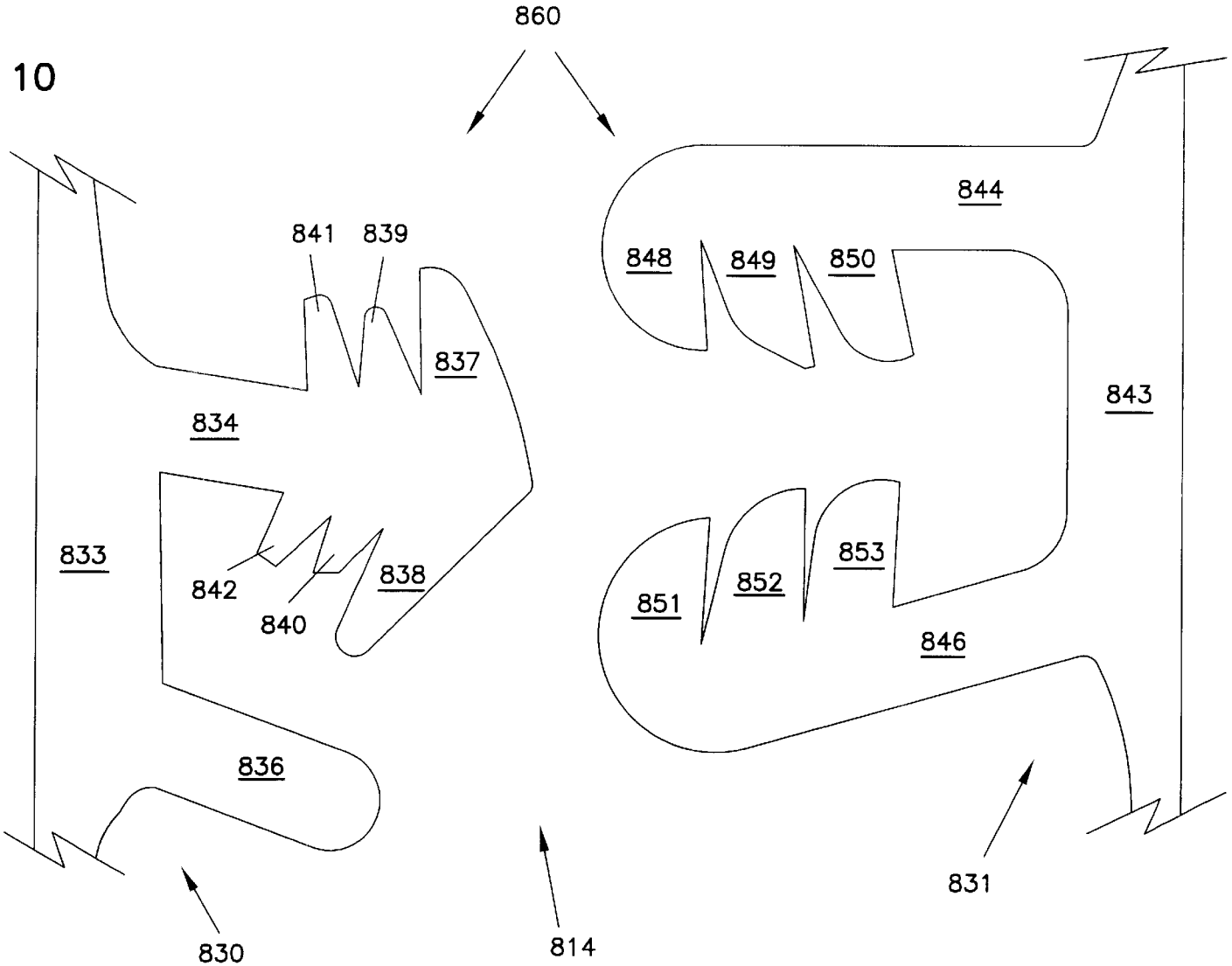
FIG. 10 is an enlarged fragmented, cross-sectional view of another alternate embodiment of a tactile feedback system, being a single-track zipper having a plurality of tactile feedback snaps, according to an example embodiment of the present invention.

Attention is directed to FIG. 10. FIG. 10 illustrates a single-track zipper 814, or closure mechanism, having a tactile feedback system 860 according to an example embodiment of the present invention. The closure mechanism 814 includes a first closure profile 830 and a second closure profile 831. The first and second closure profiles 830, 831 have a continuous cross-section across the length of the closure mechanism 814.

The preferred first closure profile 830 depicted includes a base strip 833, a first closure member or profile element 834, and a first guide post 836. The first profile element 834 extends from the base strip 833 and is generally projecting from the base strip 833. At a free end or tip of the profile element 834 are first and second hooks or catches 837, 838. Between the first and second catches 837, 838 and the base strip 833 are third, fourth, fifth, and sixth catches 839, 840, 841, 842. The guide post 836 also extends from the base strip 833 and is generally projecting from the base strip 833.

The preferred second closure profile 831 depicted includes a base strip 843 and first and second closure members or profile elements 844, 846. The profile elements 844, 846 extend from the base strip 843 and are generally projecting from the base strip 843. At a free end or tip of the first profile element 844 is a first hook or catch 848. Between the first catch 848 and the base strip 843 are second and third hooks or catches 849, 850. Likewise, at a free end or tip of the second profile element 846 is a fourth hook or catch 851. Between the fourth catch 850 and the base strip 843 are fifth and sixth hooks or catches 852, 853.

With the exception of a third set of hooks or catches, the resealable closure mechanism 814 has structure that operates or functions analogous to the resealable closure mechanism 614 of FIG. 8.

The above specification and examples are believed to provide a complete description of the manufacture and use of particular embodiments of the invention. Many embodiments of the invention can be made without departing from the spirit and scope of the invention.

What is claimed is:

1. A closure arrangement for a flexible package; the closure arrangement comprising:

(a) first and second opposing profiles having a continuous cross-section; wherein:

(i) the first profile includes a first guide post and a first profile element having a first plurality of feedback ribs projecting at least 0.003 inches from the first profile element;

(ii) the second profile includes a second profile element, having a second plurality of feedback ribs projecting at least 0.003 inches from the second profile element, and a third profile element;

(iii) wherein the second and third profile elements are arranged and configured to selectively interlock with the first profile element;

(iv) wherein the feedback ribs have a shape comprised of at least one of the group consisting of triangular, rectangular, and round; and (b) whereby the first and second plurality of feedback ribs interact to allow a user of the package to sense when the first and second profiles are interlocking.

2. A closure arrangement according to claim 1, wherein:

(a) the first profile further includes a first base strip, the first guide post and the first profile element projecting from the first base strip; and (b) the second profile further includes a second base strip, the second and third profile elements projecting from the second base strip.

3. A closure arrangement according to claim 2, wherein (a) the first profile element includes first and second hooks extending from a first free end of the first profile element.

4. A closure arrangement according to claim 3, wherein:
(a) the second profile element includes a third hook extending from a second free end of the second profile element; and
(b) the third profile element includes a fourth hook extending from a third free end of the third profile element.

5. A closure arrangement according to claim 1, wherein:
(a) the first and second profiles comprise polyethylene or polypropylene.

6. A closure arrangement for a flexible package; the closure arrangement comprising:
(a) first and second opposing profiles having a continuous cross-section; wherein:
(i) the first profile includes a first profile element and a first guide post and a first plurality of feedback ribs projecting from the first profile element; and
(ii) the second profile includes second and third profile elements and a second plurality of feedback depressions extending into the second and third profile elements, and wherein:
(A) the second and third profile elements are arranged and configured to selectively interlock with the first profile element; and
(B) the first plurality of feedback ribs is arranged and configured to interact with the second plurality of feedback depressions to allow a user to sense when the first and second profiles are interlocking.

7. A closure arrangement according to claim 6, wherein
(a) the first plurality of feedback ribs project at least 0.003 inches from the first profile; and
(b) the second plurality of feedback depressions extend into the second profile at least 0.003 inches.

8. A closure arrangement according to claim 6, wherein:
(a) the first plurality of feedback ribs have a shape comprised of at least one of the group consisting of triangular, rectangular, and round; and
(b) the second plurality of feedback depressions have a shape comprised of at least one of the group consisting of triangular, rectangular, and round.

9. A closure arrangement for a flexible package; the closure arrangement comprising:
(a) first and second opposing profiles having a continuous cross-section; wherein:
(i) the first profile includes a first profile element and a first guide post, a first plurality of feedback depressions extending into the first profile element;
(ii) the second profile includes second and third profile elements and a second plurality of feedback devices projecting from the second and third profile elements;
(iii) the second and third profile elements arranged and configured to selectively interlock with the first profile element; and
(b) whereby the first plurality of feedback depressions and the second plurality of feedback devices interact to allow a user of the package to sense when the first and second profiles are interlocking.

10. A closure arrangement according to claim 9, wherein:
(a) the second plurality of feedback devices include feedback ribs projecting from the second profile.

11. A closure arrangement according to claim 10, wherein:
(a) the feedback depressions extend at least 0.003 inches into the first profile; and
(b) the feedback ribs project at least 0.003 inches from the second profile.

12. A closure arrangement for a flexible package; the closure arrangement comprising:
(a) first and second opposing profiles having a continuous cross-section, the first profile having at least a first profile element having at least first, second, third, and fourth catches projecting therefrom; and
(b) the second profile having a plurality of feedback devices; the second profile having at least second and third profile elements; the second profile element having at least fifth and sixth catches projecting therefrom, and the third profile element having at least seventh and eighth catches; and
(i) wherein the second and third profile elements are arranged and configured to selectively interlock with the first profile element.

13. A closure arrangement according to claim 12, wherein:
(a) the sixth and eighth catches comprise the second plurality of feedback devices of the second profile.

14. A flexible package comprising:
(a) first and second opposing film walls having first and second side seals and a mouth therebetween; the mouth providing access to a package interior;
(b) first and second opposing profiles along the mouth for sealing the mouth;
(i) the first and second opposing profiles having a continuous cross-section;
(ii) the first profile includes a first profile element and a first guide post, and a first plurality of feedback ribs projecting from the first profile element;
(iii) the second profile includes second and third profile elements and a second plurality of feedback depressions extending into the second and third profile elements;
(iv) the second and third profile elements arranged and configured to selectively interlock with the first profile element; and
(v) whereby the first plurality of feedback ribs interacts with the second plurality of feedback depressions to allow a user of the package to sense when the first and second profiles are interlocking.

15. A flexible package according to claim 14, wherein
(a) the first plurality of feedback ribs project at least 0.003 inches from the first profile; and
(b) the second plurality of feedback depressions extend at least 0.003 inches into the second profile.

16. A flexible package according to claim 14, wherein:
(a) the first plurality of feedback ribs have a shape comprised of at least one of the group consisting of triangular, rectangular, and round; and
(b) the second plurality of feedback depressions have a shape comprised of at least one of the group consisting of triangular, rectangular, and round.

17. A flexible package comprising:
(a) first and second opposing film walls having first and second side seals and a mouth therebetween; the mouth providing access to a package interior;
(b) first and second opposing profiles along the mouth for sealing the mouth;
(i) the first and second opposing profiles having a continuous cross-section;
(ii) the first profile including a first profile element having a plurality of first, second, third and fourth catches projecting from the first profile element;
(iii) the second profile having at least second and third profile elements, and includes a plurality of feedback devices, the second profile element having at least fifth and sixth catches, and the third profile element having at least seventh and eighth catches;

(iv) the second and third profile elements arranged and configured to selectively interlock with the first profile element; and (v) whereby the plurality of catches and the plurality of feedback devices interact to allow a user of the package to sense when the first and second profiles are interlocking.

18. A flexible package according to claim 17, wherein:

(a) the sixth and eighth catches comprise the second plurality of feedback devices of the second profile.

* * * * *